US007507164B2

(12) United States Patent
Owen

(10) Patent No.: US 7,507,164 B2
(45) Date of Patent: Mar. 24, 2009

(54) CUE STICK AND METHOD OF MAKING SAME

(76) Inventor: Donald W. Owen, 5410 Onset Bay Dr., Rowlett, TX (US) 75089

( * ) Notice: Subject to any disclaimer, the term of this patent is extended or adjusted under 35 U.S.C. 154(b) by 0 days.

(21) Appl. No.: 11/076,833

(22) Filed: Mar. 10, 2005

(65) Prior Publication Data

US 2006/0205525 A1 Sep. 14, 2006

(51) Int. Cl.
*A63D 15/08* (2006.01)

(52) U.S. Cl. ..... 473/44; 473/49

(58) Field of Classification Search ..... 473/44–51
See application file for complete search history.

(56) References Cited

U.S. PATENT DOCUMENTS

| | | | | | |
|---|---|---|---|---|---|
| 132,054 | A | * | 10/1872 | Coan et al. | 473/44 |
| 672,646 | A | * | 4/1901 | Mereness | 473/44 |
| 941,728 | A | * | 11/1909 | Preast | 473/44 |
| 951,453 | A | * | 3/1910 | Ransom | 473/44 |
| 1,210,076 | A | * | 12/1916 | Jost | 473/44 |
| 1,241,194 | A | * | 9/1917 | Carlson et al. | 473/44 |
| 1,248,634 | A | * | 12/1917 | DuBose | 473/44 |
| 1,505,609 | A | * | 8/1924 | Barach et al. | 473/44 |
| 1,565,612 | A | * | 12/1925 | Ajello | 473/49 |
| 5,725,437 | A | | 3/1998 | McCarty et al. | |
| 5,749,788 | A | * | 5/1998 | Bourque | 473/44 |
| 5,820,473 | A | * | 10/1998 | Lambros | 473/44 |
| 6,110,051 | A | | 8/2000 | McCarty et al. | |
| 6,132,321 | A | * | 10/2000 | Wethered | 473/47 |
| 6,162,128 | A | | 12/2000 | McCarty et al. | |
| 2002/0072423 | A1 | * | 6/2002 | Pot | 473/44 |
| 2002/0072424 | A1 | * | 6/2002 | Yu | 473/44 |
| 2002/0082098 | A1 | * | 6/2002 | Lai Chuang | 473/44 |
| 2002/0132677 | A1 | * | 9/2002 | Chang | 473/44 |
| 2004/0116196 | A1 | * | 6/2004 | Nazaruk | 473/44 |
| 2004/0224781 | A1 | * | 11/2004 | Davtyan et al. | 473/44 |

FOREIGN PATENT DOCUMENTS

| | | | |
|---|---|---|---|
| GB | 1809 | * | 9/1905 |
| GB | 180514 | * | 6/1922 |
| IT | 421212 | * | 1/1948 |

OTHER PUBLICATIONS

"Spence Cues" at http://cu.imt.net/~spencecues/about.htm, visited at Jan. 10, 2005.

"Everything You Always Wanted to Know About Cue Ball Squirt, But Were Afraid to Ask," by Ron Shepard, Sep. 1, 2001.

(Continued)

*Primary Examiner*—Mark S Graham
(74) *Attorney, Agent, or Firm*—McAfee & Taft

(57) ABSTRACT

A cue stick comprises a base shaft having improved warp resistance, a tip end piece having a high compressive and bend strength to weight ratio, and a sleeve having a high band strength to weight ratio. The base shaft comprises multiple rounded, longitudinal sections and a longitudinal cavity. A dampening material may be disposed in the longitudinal cavity. The sleeve comprises a plurality of stacked wood layers. Methods of making the cue stick and components thereof are also provided.

30 Claims, 10 Drawing Sheets

OTHER PUBLICATIONS

"Tiger X Shaft Partial Blank," at http://www.cuestik.com, visited at Jan. 9, 2005.
"Fusion tm Initial Taper Shaft," at http://www.cuestik.com, visited at Jan. 10, 2005.
"Flat Laminated Shaft Dowels," at http://www.cuecomponents.com, visited at Jan. 9, 2005.
"Intimidator® i-Series Shaft System," at http://www.mcdermottcue.com, visited Apr. 27, 2005.

* cited by examiner

CUE STICK AND METHOD OF MAKING SAME

BACKGROUND OF THE INVENTION

1. Field of the Invention

This invention relates to a cue stick for playing pool or billiards and methods of making the cue stick and components thereof.

2. Description of the Prior Art

A cue stick for playing pool or billiards is typically an elongated tapered shaft with a handle at one end and a tip at the other end. The shaft and handle can be integrally formed or comprised of two or more members engaged together. Generally the cue stick is made of a hardwood such as hard maple; however, it can also be made of a non-wood material such as aluminum, stainless steel or plastic.

In order to provide optimum performance, a cue stick needs to be stiff and perfectly straight. It is also desirable for the cue stick to generate minimal vibration when striking the cue ball, and to provide a radially consistent "feel" and performance regardless of the orientation or rotation of the cue stick in the player's hand.

One problem with wood cues is that they can warp. Due to variations in moisture content, all wood expands and contracts which can lead to a bowed or warped cue stick. The warping problem has been addressed by forming the shaft using flat laminated wood rods or multiple pie-shaped wood sections. While these approaches have increased the warp resistance of wood cue sticks, there is still room for improvement.

A sleeve is generally mounted around the tip end of a cue stick to prevent splitting and wear of the tip end due to impact of the tip with the cue ball. For proper playing action, the tip end should have a high strength-to-weight ratio. In order to achieve the required strength, sleeves are typically made of ivory or reinforced plastic. Unfortunately, sleeves made of such materials are relatively heavy which can adversely affect the performance of the cue stick. For example, it has been demonstrated that a relatively low tip end mass relative to the cue ball mass helps decrease cue ball deflection when the cue ball is struck off center to impart spin.

Thus, there is a need for a cue stick and cue stick components that are highly resistant to becoming warped, generate minimal vibration and have a radially consistent feel and performance. There is also a need for a cue stick sleeve that has sufficient compression and bending strength yet is relatively light in weight.

SUMMARY OF THE INVENTION

The present invention provides an improved cue stick and cue stick components which meet the needs described above. The invention also includes methods for manufacturing the cue stick and certain components thereof.

In a first embodiment, the cue stick of this invention comprises a base shaft, a tip end piece, an inner core pin, and a sleeve. The base shaft has a first end, a second end opposed to the first end, an internal anchoring space extending through the second end, and a longitudinal cavity disposed between the first end and the second end. The longitudinal cavity is at least 12 inches in length.

The tip end piece has a lower portion extending through the second end of the base shaft into the internal anchoring space of the base shaft, an upper portion spaced from the lower portion, and a bore disposed between the lower portion and the upper portion and extending through the lower portion.

The tip end piece further comprises a first end and a second end opposed to the first end. The inner core pin extends at one end through the second end of the base shaft into the internal anchoring space of the base shaft, and extends at the other end through the lower portion of the tip end piece into the bore of the tip end piece. A sleeve extends around the upper portion of the tip end piece. The sleeve has a bottom edge and a top edge opposed to the bottom edge. The second end of the tip end piece is flush with the top edge of the sleeve. A cue tip is attached to the second end of the tip end piece.

The base shaft may extend the entire length of the cue stick, excluding the length of the tip end piece, in which case the base shaft includes the handle of the cue stick. Alternatively, the base shaft extends from the first end of the tip end piece for only a portion of the cue stick length, in which case a separate handle is attached to the first end of the base shaft.

One or more components of the inventive cue stick, namely the base shaft and/or handle, each comprises at least three longitudinal, rounded sections attached together. Each section has a longitudinally extending concave surface, a longitudinally extending convex surface, and an arcuate outer surface. The concave surface of each section abuts the convex surface of an adjacent section. Preferably, the sections are formed of wood wherein the wood fiber orientation runs longitudinally and the end grain direction of each section varies from the end grain direction of adjacent sections. If the handle is formed of such construction, it may be covered by a decorative outer veneer or sleeve. As mentioned above, such a handle may be integrally formed with the base shaft or may be a separate component attached to the first end of the base shaft.

The tip end piece of the inventive cue stick is made of basswood or multiple layers of wood oriented substantially parallel to the longitudinal axis of the tip end piece. The inner core pin that extends at one end into the internal anchoring space of the base shaft, and extends at the other end through the lower portion of the tip end piece, preferably has a compressive strength of 1500 psi or greater and a specific gravity of 0.3 or less, and is preferably made of balsa wood.

The sleeve of the inventive cue stick is attached around the upper portion of the tip end piece. The sleeve preferably comprises a plurality of stacked wood layers wherein the wood cell fibers of each layer extend within the plane of the layer and each layer is oriented in a plane perpendicular to the longitudinal axis of the tip end piece. Preferably the wood cell fiber orientation of each layer varies from the fiber orientation of an adjacent layer.

In a second embodiment, the inventive cue stick comprises a base shaft, a tip end piece, and a sleeve. In this embodiment, the base shaft and sleeve are as described above. The tip end piece, however, is different. Further, this embodiment of the cue stick does not include the inner core pin. The tip end piece has a lower portion extending through the second end of the base shaft and into the internal anchoring space of the base shaft. The sleeve extends around an upper portion of the tip end piece. The tip end piece preferably comprises multiple alternating layers of a hardwood, each layer having a compressive strength of 4500 psi or greater, and another wood having a specific gravity of 0.4 or less.

A method of this invention for making a cue stick comprises the following steps. Three or more blanks are lathe-turned to form dowels having a predetermined radius. A groove is cut in each dowel wherein the groove defines an arc with a radius the same as the predetermined dowel radius, thereby producing shaped rods having a longitudinally extending concave surface and a longitudinally extending convex surface. The shaped rods are arranged such that the concave surface of each shaped rod abuts the convex surface of an adjacent shaped rod to form a substantially solid bundle having a symmetrical cross section. Each shaped rod is then affixed to an adjacent shaped rod at a contact surface defined by abutting concave and convex walls. Preferably, six shaped rods are bundled and affixed using an adhesive. The bundle is clamped using a hexagonal clamp until the glue has dried or the epoxy has cured. If desired, an axial bore is drilled through at least a portion of the bundle. The bore may be filled with a filling material or a vibration-dampening material.

A method of this invention for making a reinforcing sleeve for a cue stick comprises the following steps. A plurality of wood layers, each having a fiber orientation in the plane of the layer, are coated with an adhesive. A laminated starting block is formed by attaching a cutting pattern to one end and stacking the coated layers to a height in the range of from about one to about one and one-half inches and such that the fiber orientation of adjacent layers is misaligned. Square blanks are cut from the laminated starting block; each blank is machined to a sleeve by rounding the external surface and drilling out the center.

The features and advantages of the present invention will become readily apparent to those skilled in the art upon a reading of the following description of preferred embodiments taken in conjunction with the accompanying drawings.

BRIEF DESCRIPTION OF THE DRAWINGS

FIG. 6 is a cross-sectional view taken along line 6-6 of FIG. 5.

DESCRIPTION OF THE PREFERRED EMBODIMENTS

A. Cue Stick

Figures 1A, 1B, 1C:
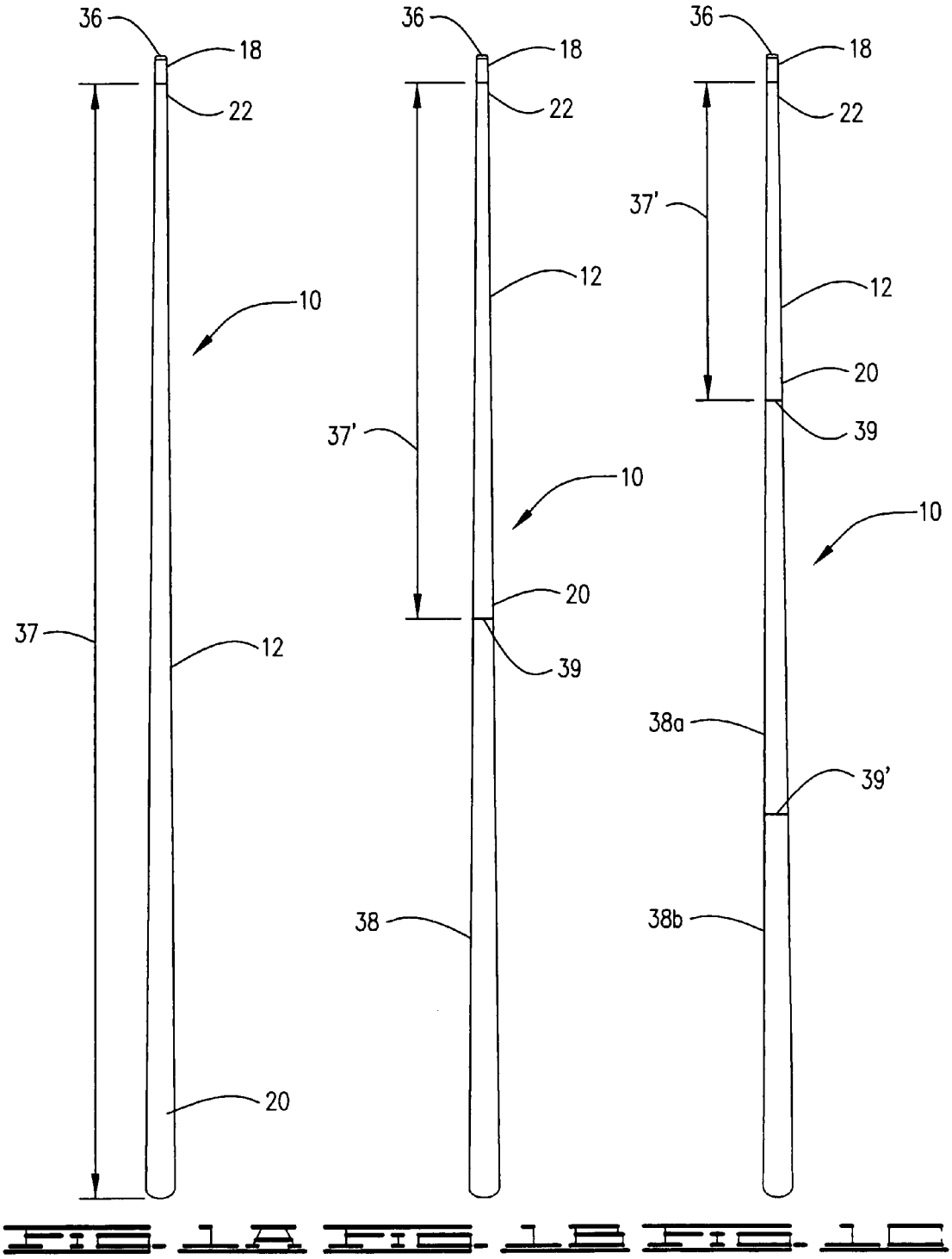
FIGS. 1A-1C are perspective views of a cue stick of this invention.

As mentioned, the cue stick of this invention has an improved resistance to warping and a radially consistent feel and performance. The cue stick has dampened vibration and includes a tip end section that has a low mass, high strength and durability, and high performance characteristics.

Referring to FIGS. 1A-3C, the cue stick 10 of this invention comprises a base shaft 12, a tip end piece 14, an inner core pin 16, and a sleeve 18. The base shaft 12 has a first end 20, a second end 22 opposed to the first end, an internal anchoring space 23 extending through the second end, and a longitudinal cavity 24 disposed between the first end 20 and the second end 22. The longitudinal cavity 24 extends at least 12 inches, preferably at least 20 inches, in length. The tip end piece 14 has a lower portion 26 extending through the second end 22 of the base shaft into the internal anchoring space 23 of the base shaft, an upper portion 28 spaced from the lower portion 26, and a bore 30 disposed between the lower portion 26 and the upper portion 28 and extending through the lower portion 26. The inner core pin 16 extends at one end 32 through the second end 22 of the base shaft into the internal anchoring space 23 of the base shaft, and extends at the other end 34 through the lower portion 26 of the tip end piece into the bore 30 of the tip end piece. The sleeve 18 extends around the upper portion 28 of the tip end piece. A cue tip 36 is attached to the tip end piece.

The base shaft 12 may extend the entire length 37 of the cue stick, excluding the tip end length, as in FIG. 1A, or it may extend for a lesser portion 37' of the cue stick length, in which case a handle 38 is attached to the first end 20 of the base shaft at a joint 39 as shown in FIG. 1B. The "handle" is defined herein to include any portion of the cue stick attached to the base shaft first end 20. The use of joint 39 in a cue stick allows the player to separate the two pieces for ease in carrying and storing the cue stick. Another common configuration comprises two joints, 39 and 39' as shown in FIG. 1C. In this case, the handle comprises more than one longitudinal piece, namely handle piece 38*a* and handle piece 38*b*. Typically joints 39 and 39' are bolt-type couplings allowing the handle to be readily engaged and disengaged. Many players have their own personal handle; therefore, the handle may be a separate and previously existing handle. Preferably the handle is constructed according to this invention. The handle may additionally be covered by an outer veneer or sleeve comprising decorative material.

Figure 3A:
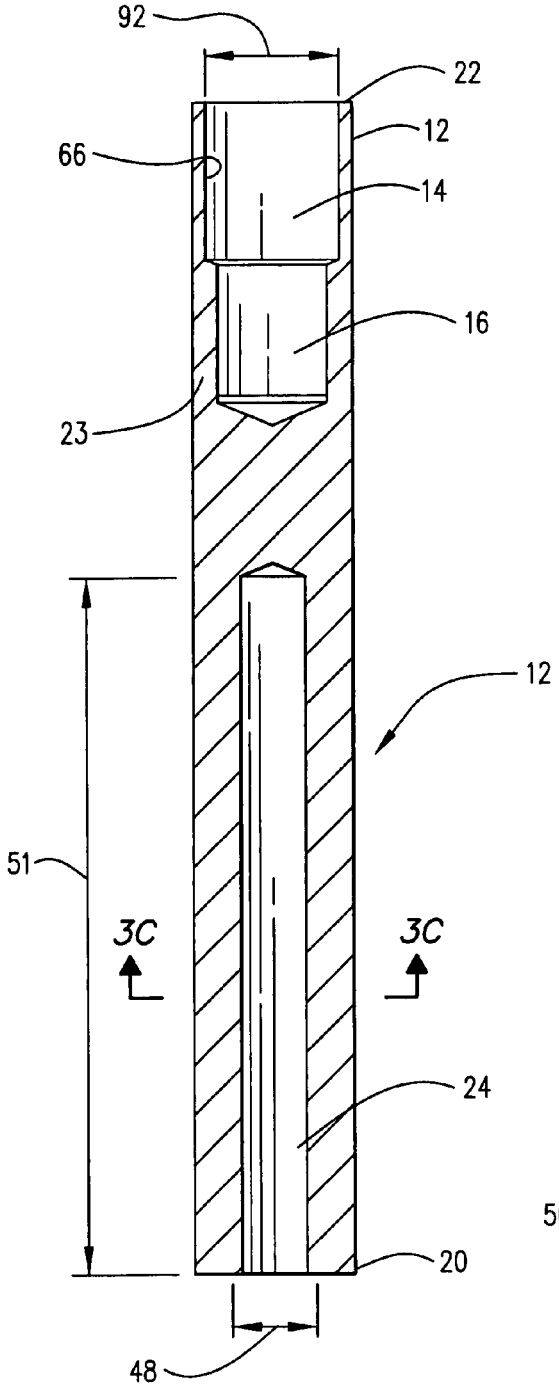
FIG. 3A is a sectional view of the base shaft of this invention.
Figure 3B:
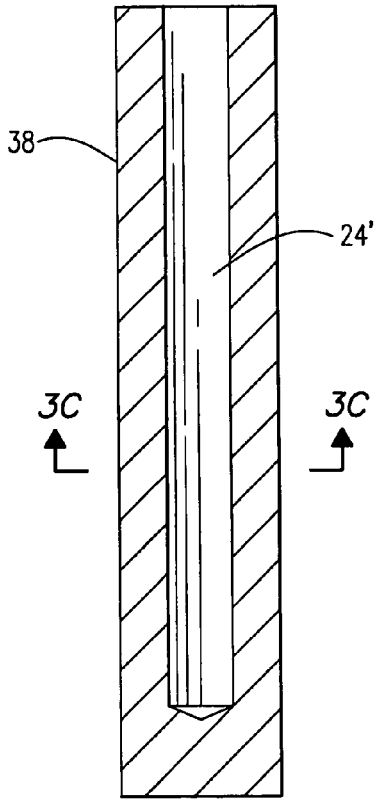
FIG. 3B is a sectional view of the handle of the invention.
Figure 3C:
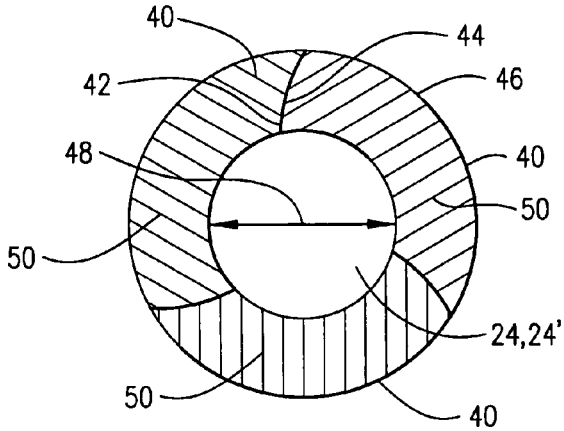
FIG. 3C is a cross-sectional view taken along line 3C-3C of either FIG. 3A or FIG. 3B.
Figure 4A:
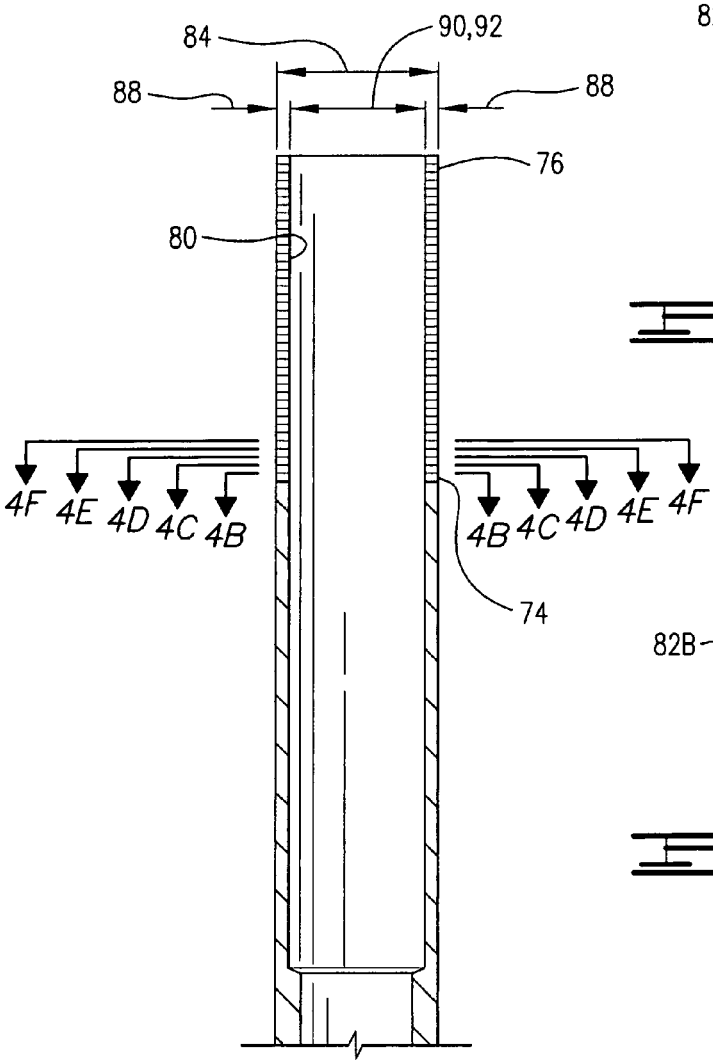
FIG. 4A illustrates the sleeve of this invention.
Figure 4B:
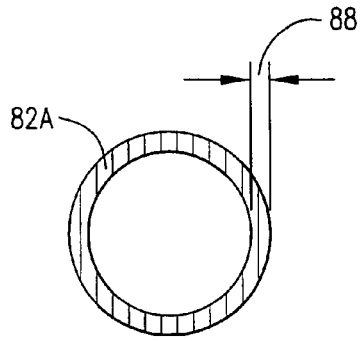
FIG. 4B is a cross-sectional view taken along line 4B-4B of FIG. 4A.
Figure 4C:
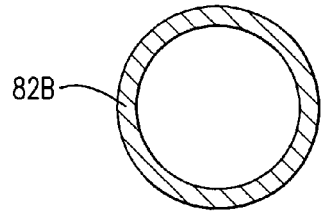
FIG. 4C is a cross-sectional view taken along line 4C-4C of FIG. 4A.
Figure 4D:
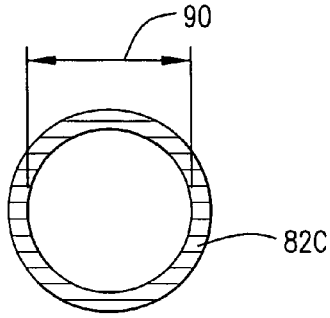
FIG. 4D is a cross-sectional view taken along line 4D-4D of FIG. 4A.
Figure 4E:
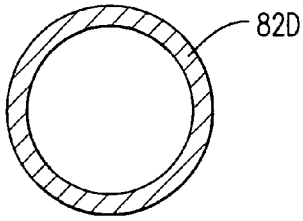
FIG. 4E is a cross-sectional view taken along line 4E-4E of FIG. 4A.
Figure 4F:
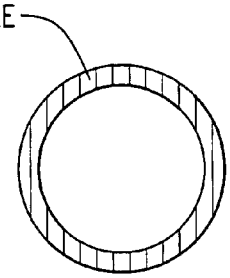
FIG. 4F is a cross-sectional view taken along line 4F-4F of FIG. 4A.

Referring to FIGS. 3A-3C, one or more components of the inventive cue stick, namely the base shaft 12 and/or handle 38 (or section thereof), each comprise a plurality of longitudinal rounded sections 40 attached together. As used herein and in the appended claims, a "rounded" section means a section having only curved longitudinal surfaces, i.e., having no flat longitudinal surfaces. A component comprising rounded longitudinal sections has less of a tendency to warp, in part because the process of shaping the rounded sections results in less internal stress as will be described later. Preferably the rounded longitudinal sections have been formed by a stepwise removal of outer wood layers between two end points.

The base shaft 12 and/or handle 38 (or section thereof) preferably each include at least three longitudinal, rounded sections 40 attached together. More preferably, the base shaft 12 and/or handle 38 (or section thereof) each include six rounded sections attached together. Each section has a longitudinally extending concave surface 42, a longitudinally extending convex surface 44, and an arcuate outer surface 46. The concave surface 42 of each section abuts the convex surface 44 of an adjacent section. Preferably, the longitudinal sections 40 are attached together with an adhesive. Examples of suitable adhesives for attaching the sections 40 together are epoxy resins, polyvinyl acetates, and polyurethane.

The longitudinal rounded sections 40 are preferably made of wood. The term "wood" as used herein and in the appended claims is defined to include naturally fibrous materials such as hardwoods and bamboo, as well as synthetic fibrous materials having properties similar to wood. Preferably wood refers to naturally fibrous materials. Examples of suitable wood include, but are not limited to, maple, oak, birch, hickory, white ash, and black cherry. More preferably, each section 40 is formed of multiple glued layers of hardwood. Most preferably, each section 40 is formed of laminated maple hardwood. When a laminated hardwood is used, preferably each layer has a thickness in the range of about 1/32 inch to about 1/8 inch. More preferably the layers have a thickness of about 1/16 inch.

The wood used to form the rounded longitudinal sections 40 comprises elongated wood cell fibers arranged in a generally uniform orientation. Preferably the wood cell fiber orientation is aligned longitudinally in each longitudinal rounded section 40. If the wood is laminated, preferably each layer is also aligned longitudinally with the section 40.

As shown by FIG. 3C, the wood used to form the longitudinal sections also has an end grain 50. The "end grain" 50 of a longitudinal section 40 is defined as the growth lines in the case of a section formed of a single piece of wood, and the glue lines in the case of a section formed of laminated wood. As used herein and in the appended claims, the "end grain direction" is defined as the direction of the growth lines in the case of a section made from a single piece of wood, or the direction of the glue lines in the case of a section made from laminated wood. Preferably the end grain direction of each section 40 varies from the end grain direction of adjacent sections 40. Varying the end grain direction of each section helps to achieve a more uniform radial distribution of the physical properties of the wood. Preferably, the end grain direction of each section varies by at least 10 degrees from the end grain direction of the sections adjacent thereto. More preferably, the end grain direction varies by about (360/n) degrees, where n is the number of sections used to form the base shaft or handle. For example, in a base shaft comprising three longitudinal rounded sections, as shown in FIG. 3C, the end grain of each section should vary by about (360/3) or 120 degrees from the adjacent sections.

Referring now to FIG. 3A, preferably a longitudinal cavity 24 is disposed between the first end 20 and the second end 22 of the base shaft 12 and extends at least 12 inches along the length of the base shaft. More preferably, the length 51 of the longitudinal cavity is at least 20 inches. Preferably the longitudinal cavity diameter 48 is in the range of about 30% to about 80% of the base shaft diameter at the first end 20, and more preferably about 5/16 inch. Similarly, as shown by FIG. 3B, a longitudinal handle cavity 24' may be disposed along the length of the handle.

The longitudinal cavity 24 and longitudinal handle cavity 24' can be left vacant to increase flexibility of the shaft or may be filled with a filling material. For example, a filling material can be added to the cavity 24 and/or cavity 24' to increase the weight of the cue stick. Preferably, the cavity 24 is filled with a vibration-dampening material to reduce the vibration felt by the player due to impacting a cue ball with the cue stick. The vibration-dampening material preferably has a high surface area that diffuses reflections and attenuates the vibration as it reflects off the surface. Examples of suitable dampening materials include, but are not limited to, cork, foam, sponge, and balsa wood.

Figure 2:
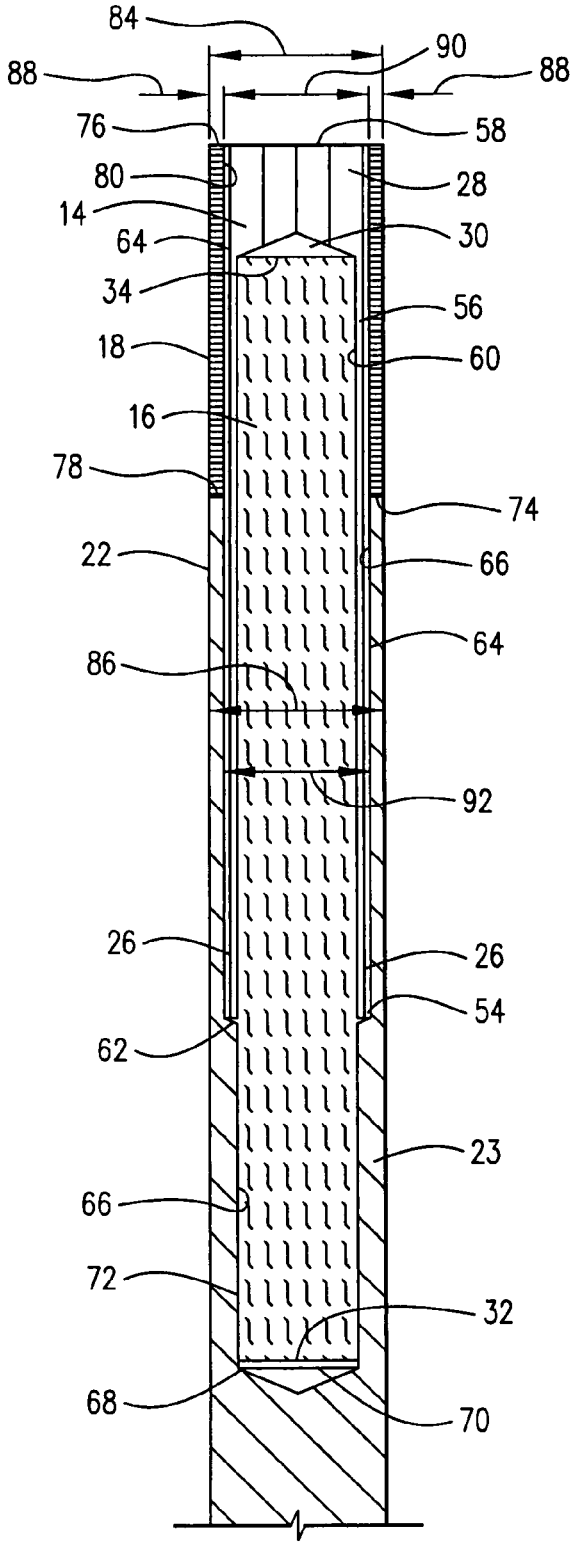
FIG. 2 is a sectional view of the tip end piece, inner core pin and sleeve of one embodiment of the inventive cue stick.

Referring now to FIG. 2, the tip end piece 14 of the cue stick 10 is shaped like a cylinder and has a first, open end 54 adjacent to the lower portion 26 of the tip end piece and a second, closed end 58 adjacent to the upper portion 28 of the tip end piece. The lower portion 26 extends through the second end 22 of the base shaft into the internal anchoring space 23 of the base shaft and is stopped by a first shoulder 62. A portion of an outside surface 64 of the tip end piece 14 is affixed to an inner surface 66 of the base shaft 12. Preferably the surfaces 64 and 66 are affixed using an adhesive. Examples of suitable adhesive include, but are not limited to, those described for gluing the longitudinal rounded sections 40 together.

The tip end piece 14 is made of a material having a low specific gravity and a compression and bend strength slightly less than that of the shaft. Examples of suitable materials include, but are not limited to, basswood, aspen, black cottonwood, and butternut.

Preferably the tip end piece 14 is made of basswood, and more preferably it is made of multiple layers of basswood sheet or veneer wherein the layers are adhesively adjoined. The thickness of the wood layers used for the tip end piece 14 is preferably in the range of about 1/32 inch to about 1/8 inch. As described in the discussion of the rounded longitudinal sections 40, examples of suitable adhesives include, but are not limited to, epoxy resins, polyvinyl acetates, and polyurethane.

The inner core pin 16 extends at one end 32 through the second end 22 of the base shaft 12 into the internal anchoring space 23 of the base shaft, and is stopped by a second shoulder 68 or end 70. The inner core pin 16 extends at its other end 34 through the lower portion 26 of the tip end piece 14 and into the bore 30 of the tip end piece. A lower pin surface 72 is affixed to the inner surface 66 of the base shaft 12. An upper pin surface 56 is affixed to an inner surface 60 of the tip end piece bore. Preferably the surfaces 72 and 76 and the surfaces 56 and 60 are affixed using an adhesive. Examples of suitable adhesives are the same as described above for affixing the rounded longitudinal sections 40 together.

The inner core pin 16 provides additional structural integrity and reinforces the surface adhesion of the tip end piece 14 to the base shaft 12. In order to reduce the mass of the cue stick near the end that strikes the cue ball, and still provide integrity and reinforcement, the inner core pin 16 is preferably composed of a material that is very light but still possesses a relatively high compressive and bending strength. Preferably the inner core pin material has a compressive strength of 1500 psi or greater and a specific gravity of 0.3 or less, and more preferably is made of balsa wood.

The sleeve 18 extends around the upper portion 28 of the tip end piece. The sleeve 18 functions to prevent splitting or spreading of the end of the cue stick 10. The sleeve 18 has a bottom edge 74 and a top edge 76 opposed to the bottom edge. The bottom edge 74 of the sleeve 18 abuts an edge 78 of the second end 22 of the base shaft 12. Preferably the bottom edge 74 of the sleeve 18 and the edge 78 of the base shaft 12 are adhesively attached together. Preferably an inner surface 80 of the sleeve 18 is adhesively attached to the outside surface 64 of the tip end piece 14. The top edge 76 of the sleeve 18 is flush with the closed, second end 58 of the tip end piece 14. The cue tip 36 is attached to the second end 58 of the tip end piece.

Since it is desirable to reduce the mass of the cue stick near the end that strikes the cue ball, the sleeve 18 preferably has a specific gravity less than 1.0. More importantly, the sleeve should also have a high band strength-to-weight ratio. To maximize the band strength, the wood cell fiber orientation in the installed sleeve 18 is preferably aligned in a plane substantially perpendicular to the longitudinal axis of the cue stick. The sleeve 18 is preferably formed of multiple laminations or veneers of wood, and more preferably of multiple laminations or veneers of a hardwood or bamboo. Suitable materials for the sleeve 18 include, but are not limited to, maple, bamboo, oak, birch, hickory, white ash and black cherry.

Preferably the laminated sleeve is formed from thin hardwood layers or veneers, preferably between 0.020 inch and 0.060 inch thick, and more preferably between about 0.025 inch and 0.030 inch thick. The wood cell fibers of each layer should extend within the plane of the layer, and each layer is preferably oriented in a plane perpendicular to the longitudinal axis of the tip end piece 14. Preferably the wood cell fiber orientation of each layer varies from the fiber orientation of an adjacent layer; more preferably the wood cell fiber orientation of each layer varies by at least 10 degrees from the wood cell fiber orientation of an adjacent layer. Most preferably the wood cell fiber orientation of each layer varies by approximately 45 degrees from the wood cell fiber orientation of an adjacent layer.

Preferably, the laminated sleeve layers are arranged such that the fiber orientation of the middle layer(s) varies from the fiber orientation of both adjacent layers, more preferably by at least 10 degrees, and most preferably by about 45 degrees from the fiber orientation of both adjacent layers as shown in FIG. 4. The fiber orientations 82A-82E are symbolized by lines in each of the layers portrayed in FIG. 4. The fiber orientation of each layer varies by about 45 degrees from layer(s) adjacent thereto. In this way, the band strength is uniform in all radial directions. Each layer is preferably adhered to adjacent layer(s) with a thin coating of high strength adhesive. Generally the sleeve comprises between 20 to 70 layers of wood.

Preferably, the sleeve length is in the range of about 1.0 inch to about 0.5 inch. The outer diameter 84 of the sleeve should match the outer diameter 86 of the base shaft second end 22. The thickness of the sleeve wall 88 is preferably between about 0.025 inch and 0.060 inch and is determined by the desired band strength balanced with the desired tip section weight. The sleeve wall thickness 88 then sets or determines the inner diameter 90 of the sleeve which should match the inner diameter 92 of the base shaft second end.

Figure 5:
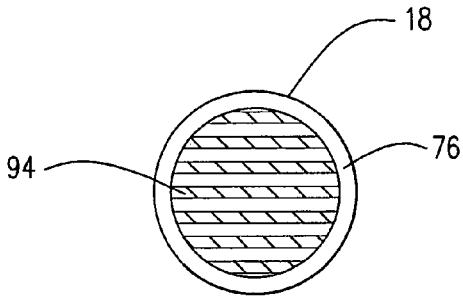
FIG. 5 is a sectional view of another embodiment of the inventive cue stick.
Figure 5:
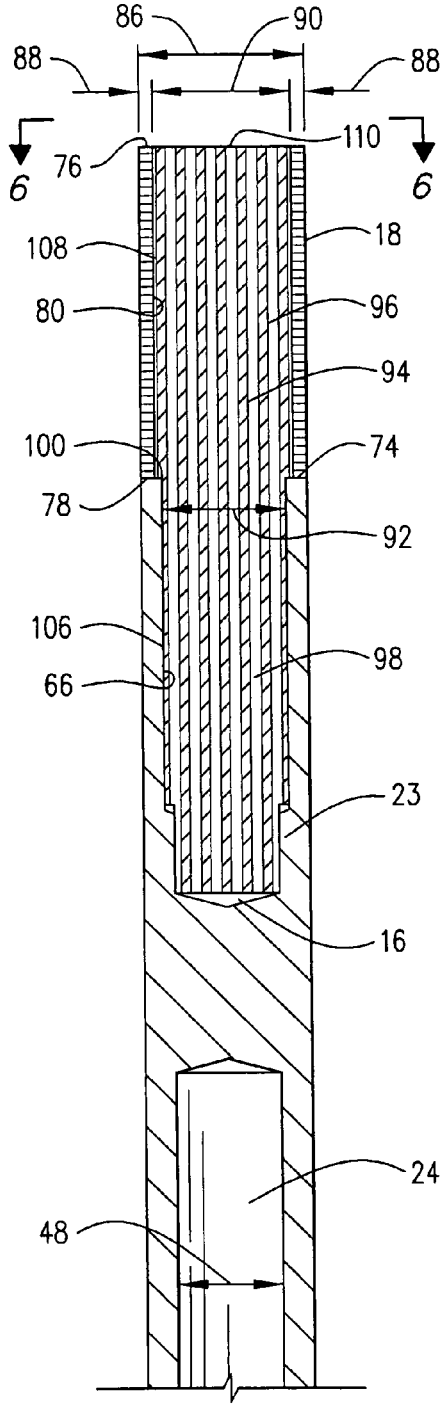

Referring now to FIGS. 5 and 6, another preferred embodiment uses a solid laminated composite tip end piece 94. The composite tip end piece 94 has an upper portion 96 and a lower portion 98. The lower portion 98 extends through the second end 22 of the base shaft 12 into the internal anchoring space 23 of the base shaft and is stopped when the edge 78 of the base shaft 12 abuts an upper shoulder 100 of the composite tip end piece 94.

A surface 106 of the lower portion 98 of the composite tip end piece 94 is preferably adhesively attached to the inner surface 66 of the base shaft 12. The sleeve 18 extends around the upper portion 96 of the composite tip end piece 94. The bottom edge 74 of the sleeve 18 abuts the edge 78 of the second end 22 of the base shaft 12. Preferably the bottom edge 74 of the sleeve 18 and the edge 78 of the base shaft 12 are adhesively attached together. Preferably the inner surface 80 of the sleeve 18 is adhesively attached to a surface 108 of the upper portion 96 of the composite tip end piece 94. The top edge 76 of the sleeve 18 is flush with a top end 110 of the composite tip end piece 94.

The composite tip end piece 94 is made by adhesively combining layers of the material described above for the tip end piece, and layers of material described for the inner core pin 16, in a manner to produce a laminate sheet. Preferably the layers are alternated and made of balsa and basswood. Preferably the wood fibers in each layer are oriented parallel to the axis of the cue stick and the layer itself is in a plane parallel to the axis of the cue stick. The thickness of each wood layer used for the composite tip end piece is preferably in the range of about 1/64 inch to about 1/8 inch. Suitable adhesives for adhesively combining the layers are the same as those described above. By alternating layers of the two materials, the combined beneficial characteristics of the tip end piece and the inner core pin are maintained in a single composite tip end piece for which the manufacturing is significantly simplified.

B. Manufacture of Base Shaft and Handle

Figure 7A:
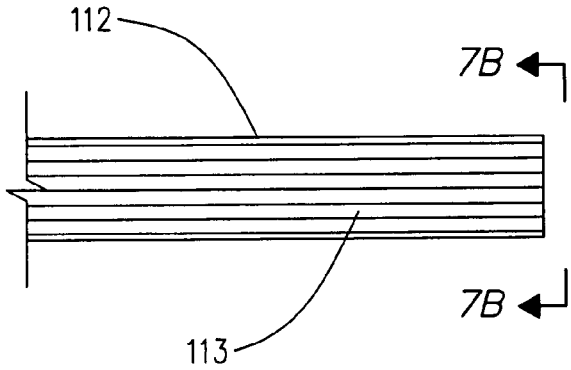
FIG. 7A illustrates a laminated dowel.
Figure 7B:
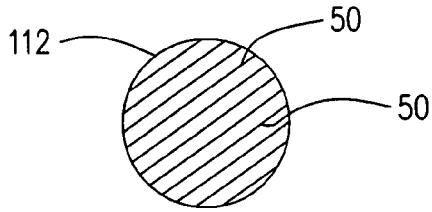
FIG. 7B is a cross-sectional view taken along line 7B-7B of FIG. 7A.

Manufacture of the base shaft 12 and handle 38 starts with making dowels such as the dowel 112 shown in FIGS. 7A and 7B. The dowel 112 can be made of any material, but preferably is made of hard wood. More preferably, the dowel 112 is made from multiple glued layers of hard wood. Most plywoods are manufactured with the fiber grain orientation varying from one layer to the next. In the present invention, however, preferably each layer is stacked such that the wood fibers are running in the same plane and in the same direction.

Dowel blanks are machined from wood or layered hardwood such that the wood fibers run longitudinally. Preferably the blank is rounded using a lathe. By turning and reducing the dowel side in multiple passes between two end points, such as on a lathe, and removing a very small amount of material in each pass, the wood is allowed to relax between passes. Thus the internal stress of the wood is relieved during the forming process. The dowel made using this procedure is much straighter and has less tendency to warp than dowels made using conventional methods.

Figure 8:
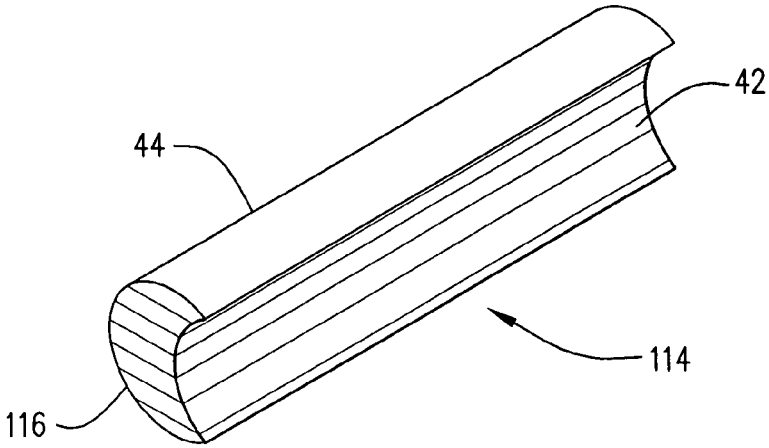
FIG. 8 is a perspective view of a shaped rod used to make the base shaft of the inventive cue stick.

Referring now to FIG. 8, after being turned to the desired diameter each dowel 112 is grooved using any procedure known to those in the art, but preferably using a round nose cutter or router bit that is the same diameter as the dowel. This procedure converts each dowel 112 to a shaped rod 114 having a crescent shaped cross-section 116. Each shaped rod has a concave surface 42 and a convex surface 44. The radius of the convex cut is equal to the radius of the concave cut. Multiple shaped rods 114 are then coated with adhesive and arranged such that the concave surface 42 of each shaped rod abuts a convex surface 44 of an adjacent shaped rod to form a substantially solid bundle 117, examples of which are shown in FIGS. 9-11.

To simplify the process, the grooves are preferably cut such that the end grain runs either parallel or perpendicular to a tangent at the center of the groove. For example, the end grain of each shaped rod in FIG. 9 runs perpendicular to a tangent at the center of the groove. In FIG. 10, the end grain runs parallel to a tangent at the center of the grain. Either method assures that the shaped rods will bundle such that the end grain direction of each section uniformly varies from adjacent sections. Varying the end grain direction provides radial symmetry to the physical properties of the finished base shaft.

Figure 9:
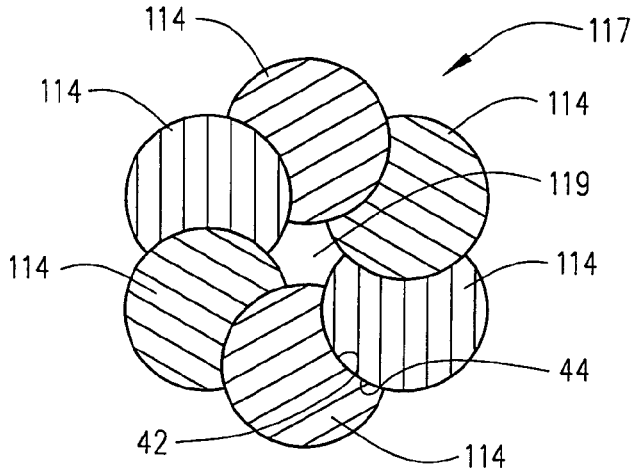
FIG. 9 is a cross-sectional view of a component arrangement used to form a base shaft or handle of the inventive cue stick.
Figure 10:
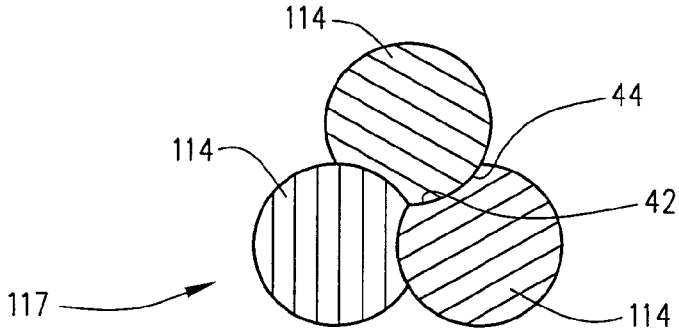
FIG. 10 is another cross-sectional view of a component arrangement used to form a base shaft or handle of the inventive cue stick.
Figure 11:
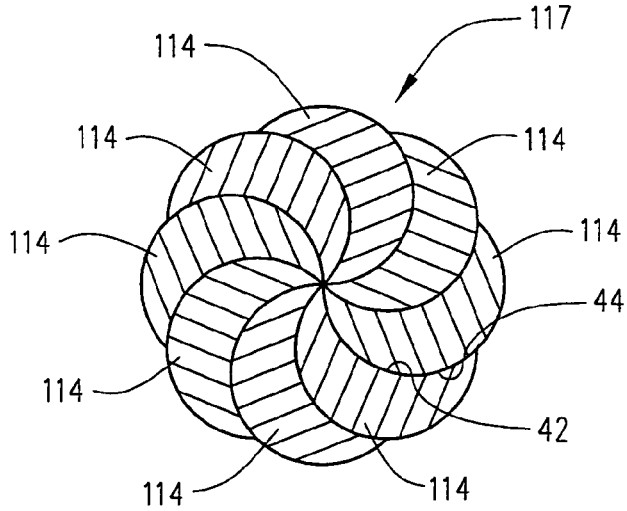
FIG. 11 is yet another cross-sectional view of a component arrangement used to form a base shaft or handle of the inventive cue stick.
Figure 12:
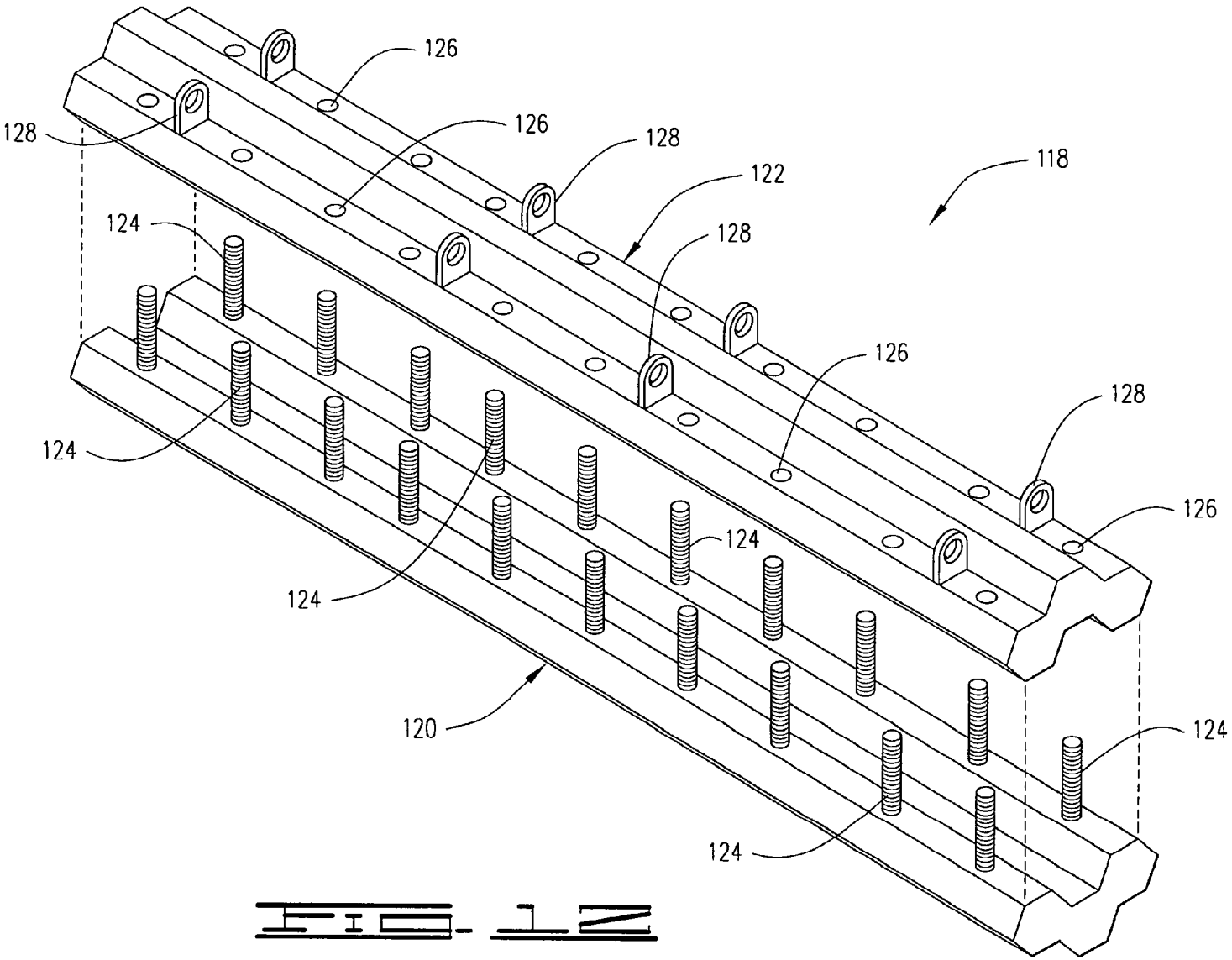
FIG. 12 is a perspective view of a hexagonal press for manufacturing a base shaft or handle of the inventive cue stick.

The bundle 117 may be arranged leaving an axial hole 119 as shown in FIG. 9, or with the sections meeting at the center as in FIGS. 10 and 11. Any number of shaped rods can be bundled. Preferably three or more shaped rods are attached together and more preferably six shaped rods are attached together. For example, six ½-inch diameter dowels are grooved to a depth of 11/64 inch (0.172 inch), coated with adhesive, bundled as in FIG. 9, placed in a 1 1/16 inch hexagonal press 118. Referring to FIG. 12, the bundle 117 is placed in a base 120 of the hexagonal press 118. The press top 122 fits such that bolts 124 protrude through bolt holes 126. The press is then securely closed and pressure uniformly applied by threading nuts (not shown) to a uniform tightness onto the bolts. After the adhesive has dried or cured, the nuts are removed and the top 122 lifted using handles 128 or the like.

Once removed from the press, the bundle 117 is machined using a lathe to produce a smooth circular outer bundle circumference. Preferably, the outer bundle circumference is then tapered by means known to those skilled in the art to produce a base shaft 12 tapered from the first end 20 to the second end 22.

The longitudinal cavity 24 and/or 24' is drilled from either end of the base shaft or the handle and extends the desired length. The longitudinal cavity 24 and/or 24' may be created using a gun drill or any other technique such as is known in the art. If an axial hole 119 is formed in the bundle 117, the hole can serve as a pilot for drilling the longitudinal cavity 24.

C. Manufacture of the Sleeve

In manufacture of a laminated sleeve, a laminated starting block is first formed from thin hardwood layers or veneers, each layer having a wood fiber orientation in the plane of the layer, and each layer being preferably between 0.020 inch and 0.060 inch thick, and more preferably between about 0.025 inch and 0.030 inch thick. Each layer is coated with a thin layer of a high strength adhesive. Examples of suitable adhesives are the same as described above.

Figure 13:
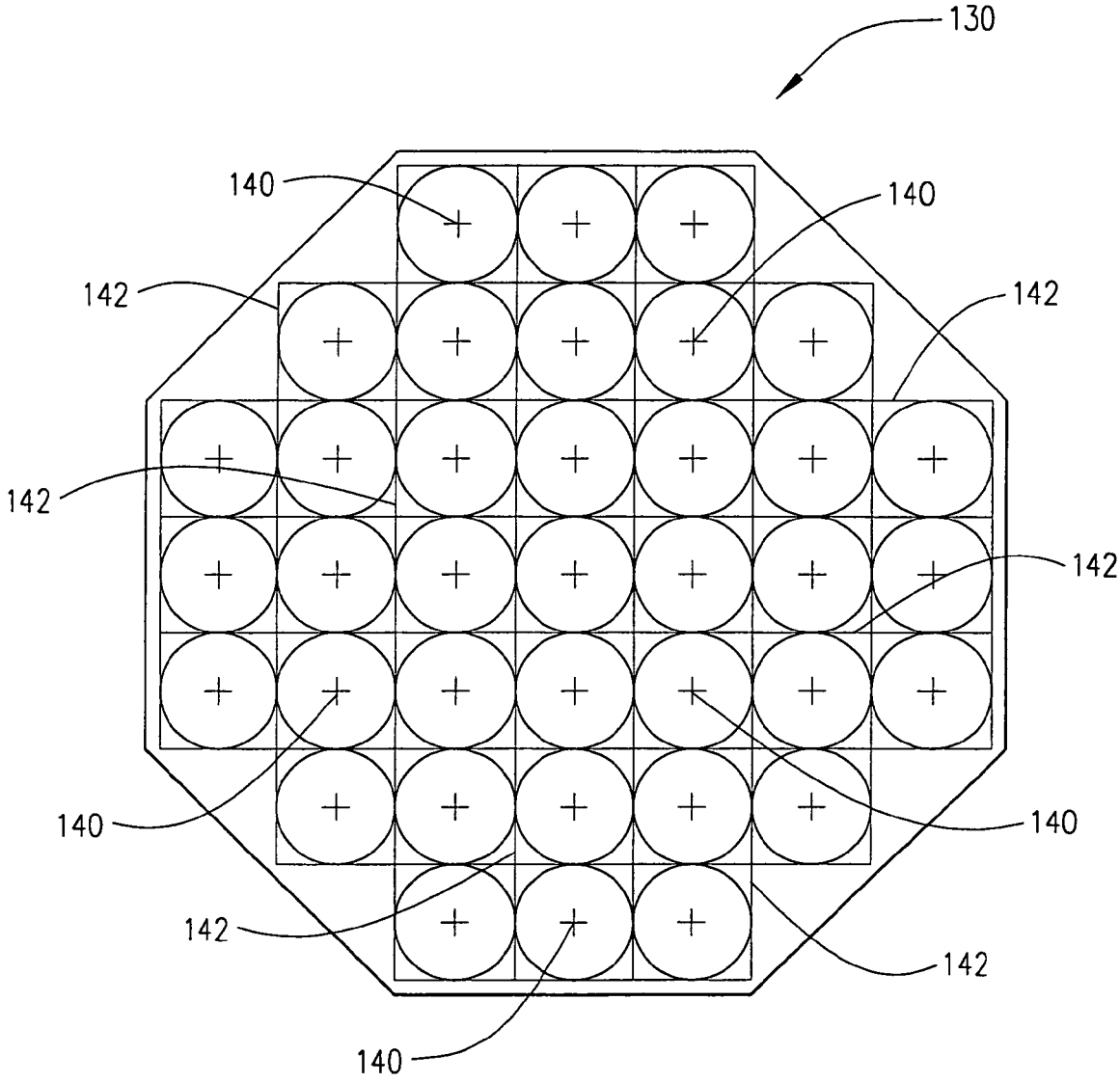
FIG. 13 is a cutting pattern for making multiple sleeves in accordance with the invention.
Figure 14A:
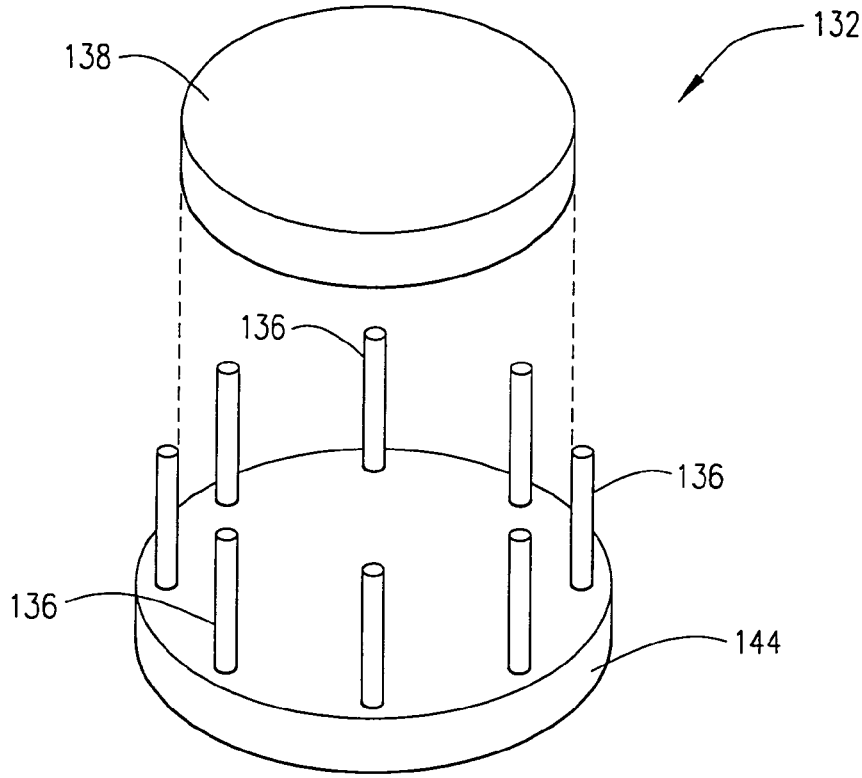
FIG. 14A is a flat press for making the sleeve laminated starting block in accordance with the invention.

A cutting pattern 130 such as the pattern shown in FIG. 13 is attached to the bottom side of the first layer which is placed in a flat press 132 as shown in FIG. 14A. A second layer is coated with adhesive and placed with the adhesive side down onto the top of the first layer and so on. The coated layers are preferably stacked such that the wood fiber orientation of each wood layer varies from the wood fiber orientation of an adjacent layer; preferably the wood fiber orientation of each layer varies by at least 10 degrees from the wood fiber orientation of an adjacent layer.

Figure 14B:
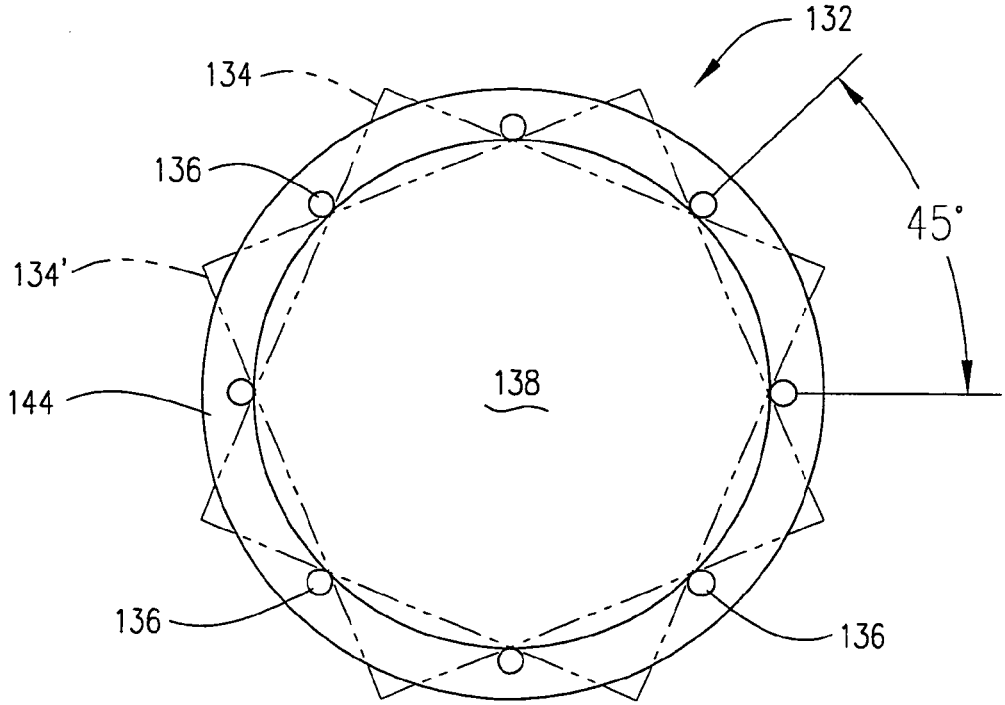
FIG. 14B shows the layer placement in the flat press in accordance with the invention.

The flat press 132 shown in FIG. 14A assists in varying the fiber orientation of each layer by approximately 45 degrees from the fiber orientation of an adjacent layer. The corners 134 of each layer fit between press rods 136. The next layer is rotated 45 degrees, or a multiple of 45 degrees, and the corner 134' of the next layer may be placed as in FIG. 14B. Generally between 20 to 70 layers are stacked and plate 138 is placed on top and clamped to the flat press 132. The layers are allowed to dry or cure to produce a laminated starting block for the sleeve.

Sleeves are machined making use of the cutting pattern 130 and using equipment and procedures known to those in the art. Preferably small holes are drilled using a drill press at each center mark 140 of the pattern attached to the laminated starting block. Square blanks are cut along lines 142 using, for example, a band saw; each blank is then rounded using, for example, a lathe. The small holes are then used as pilot holes to drill out the center and produce the sleeve. Preferred sleeve dimensions are as previously described.

While certain preferred embodiments of the invention have been illustrated and described for purposes of the present disclosure, numerous changes in the design and arrangement of parts and steps may be made by those skilled in the art, which changes are encompassed within the scope and spirit of the present invention as defined by the appended claims.

What is claimed is:

1. A cue stick, comprising:

(a) a base shaft having a first end, a second end opposed to said first end, an internal anchoring space extending through said second end, and a longitudinal cavity disposed between said first end and said second end, said longitudinal cavity being at least 12 inches in length, said base shaft comprising a plurality of longitudinal, rounded sections attached together, each of said sections being formed of wood and arranged with respect to one another such that the end grain direction of each section varies from the end grain direction of an adjacent section;

(b) a tip end piece having a lower portion extending through said second end of said base shaft into said internal anchoring space of said base shaft, an upper portion spaced from said lower portion, and a bore disposed between said lower portion and said upper portion and extending through said lower portion;

(c) an inner core pin extending at one end through said second end of said base shaft and into said anchoring space of said base shaft, and extending at the other end through said lower portion of said tip end piece into said bore of said tip end piece; and (d) a sleeve extending around said upper portion of said tip end piece.

2. The cue stick of claim 1 whereby the end grain direction of each section varies by at least 10 degrees from the end grain direction of an adjacent section.

3. The cue stick of claim 1 whereby the end grain direction of each section varies from the end grain direction of both adjacent sections.

4. A cue stick, comprising:

(a) a base shaft having a first end, a second end opposed to said first end, an internal anchoring space extending through said second end, and a longitudinal cavity disposed between said first end and said second end, said longitudinal cavity being at least 12 inches in length, said base shaft including at least three longitudinal, rounded sections attached together, each of said sections being formed of wood, and each of said sections having a longitudinally extending concave surface, a longitudinally extending convex surface, and an arcuate outer surface, wherein the concave surface of each section abuts the convex surface of an adjacent section;

(b) a tip end piece having a lower portion extending through said second end of said base shaft into said internal anchoring space of said base shaft, an upper portion spaced from said lower portion, and a bore disposed between said lower portion and said upper portion and extending through said lower portion;

(c) an inner core pin extending at one end through said second end of said base shaft and into said anchoring space of said base shaft, and extending at the other end through said lower portion of said tip end piece into said bore of said tip end piece; and (d) a sleeve extending around said upper portion of said tip end piece.

5. The cue stick of claim 4 wherein the end grain direction of each section varies from the end grain direction of the sections adjacent thereto.

6. A cue stick, comprising:

(a) a base shaft having a first end, a second end opposed to said first end, an internal anchoring space extending through said second end, and a longitudinal cavity disposed between said first end and said second end, said longitudinal cavity being at least 12 inches in length;

(b) a tip end piece having a lower portion extending through said second end of said base shaft into said internal anchoring space of said base shaft, an upper portion spaced from said lower portion, and a bore disposed between said lower portion and said upper portion and extending through said lower portion;

(c) an inner core pin extending at one end through said second end of said base shaft and into said anchoring space of said base shaft, and extending at the other end through said lower portion of said tip end piece into said bore of said tip end piece, said inner core pin being made of balsa wood; and (d) a sleeve extending around said upper portion of said tip end piece.

7. A cue stick, comprising:

(a) a base shaft having a first end, a second end opposed to said first end, an internal anchoring space extending through said second end, and a longitudinal cavity disposed between said first end and said second end, said longitudinal cavity being at least 12 inches in length;

(b) a tip end piece having a lower portion extending through said second end of said base shaft into said internal anchoring space of said base shaft, an upper portion spaced from said lower portion, and a bore disposed between said lower portion and said upper portion and extending through said lower portion;

(c) an inner core pin extending at one end through said second end of said base shaft and into said anchoring space of said base shaft, and extending at the other end through said lower portion of said tip end piece into said bore of said tip end piece; and (d) a sleeve extending around said upper portion of said tip end piece, said sleeve having a specific gravity less than 1.0.

8. A cue stick, comprising:

(a) a base shaft having a first end, a second end opposed to said first end, an internal anchoring space extending through said second end, and a longitudinal cavity disposed between said first end and said second end, said longitudinal cavity being at least 12 inches in length;

(b) a tip end piece having a lower portion extending through said second end of said base shaft into said internal anchoring space of said base shaft, an upper portion spaced from said lower portion, and a bore disposed between said lower portion and said upper portion and extending through said lower portion;

(c) an inner core pin extending at one end through said second end of said base shaft and into said anchoring space of said base shaft, and extending at the other end through said lower portion of said tip end piece into said bore of said tip end piece; and (d) a sleeve extending around said upper portion of said tip end piece, said sleeve comprising a plurality of stacked wood layers.

9. The cue stick of claim 8 wherein the wood fibers of said wood layers of said sleeve are oriented in a direction substantially perpendicular to the longitudinal axis of said tip end piece.

10. The cue stick of claim 8 wherein said wood layers of said sleeve are arranged with respect to one another such that the wood fiber orientation of each layer varies from the wood fiber orientation of an adjacent layer.

11. A cue stick, comprising:

a base shaft having a first end, a second end opposed to said first end, an internal anchoring space extending through said second end, and a longitudinal cavity disposed between said first end and said second end, said longitudinal cavity being at least 12 inches in length, said base shaft comprising a plurality of longitudinal, rounded sections attached together, each of said longitudinal, rounded sections being formed of wood and arranged with respect to one another such that the end grain direction of each section varies from the end grain direction of an adjacent section;

a tip end piece having a lower portion extending through said second end of said base shaft into said internal anchoring space of said base shaft and an upper portion spaced from said base shaft; and a sleeve extending around said upper portion of said tip end piece.

12. The cue stick of claim 11 whereby the end grain direction of each longitudinal, rounded section varies from the end grain direction of both adjacent sections.

13. A cue stick, comprising:

a base shaft having a first end, a second end opposed to said first end, an internal anchoring space extending through said second end, and a longitudinal cavity disposed between said first end and said second end, said longitudinal cavity being at least 12 inches in length, said base shaft including at least three longitudinal, rounded sections attached together, each of said sections being formed of wood, and each of said sections having a longitudinally extending concave surface, a longitudinally extending convex surface, and an arcuate outer surface, wherein the concave surface of each section abuts the convex surface of an adjacent section;

a tip end piece having a lower portion extending through said second end of said base shaft into said internal anchoring space of said base shaft and an upper portion spaced from said base shaft; and a sleeve extending around said upper portion of said tip end piece.

14. The cue stick of claim 13 wherein the end grain direction of each longitudinal, rounded section varies from the end grain direction of the sections adjacent thereto.

15. The cue stick of claim 13 wherein each of said longitudinal rounded sections is formed of a laminated hard wood.

16. A cue stick, comprising:

a base shaft having a first end, a second end opposed to said first end, and an internal anchoring space extending through said second end, said base shaft comprising a plurality of longitudinal, rounded sections attached together, each of said longitudinal rounded sections having a pair of longitudinally extending side surfaces, each of said longitudinally extending side surfaces being attached to a longitudinally extending side surface of an adjacent longitudinal rounded section;

a tip end piece having a lower portion extending through said second end of said base shaft into said internal anchoring space of said base shaft and an upper portion spaced from said base shaft;

a cue tip attached to said tip end piece; and a sleeve extending around said upper portion of said tip end piece adjacent to said cue tip to prevent splitting or spreading of said tip end piece, said tip end piece comprising multiple layers of wood, said layers being oriented substantially parallel to a longitudinal axis of said tip end piece.

17. A cue stick, comprising:

a base shaft having a first end, a second end opposed to said first end, an internal anchoring space extending through said second end, and a longitudinal cavity disposed between said first end and said second end, said longitudinal cavity being at least 12 inches in length;

a tip end piece having a lower portion extending through said second end of said base shaft into said internal anchoring space of said base shaft and an upper portion spaced from said base shaft; and a sleeve extending around said upper portion of said tip end piece, said sleeve having a specific gravity less than 1.0.

18. A cue stick, comprising:

a base shaft having a first end, a second end opposed to said first end, an internal anchoring space extending through said second end, and a longitudinal cavity disposed between said first end and said second end, said longitudinal cavity being at least 12 inches in length;

a tip end piece having a lower portion extending through said second end of said base shaft into said internal anchoring space of said base shaft and an upper portion spaced from said base shaft; and a sleeve extending around said upper portion of said tip end piece, said sleeve comprising a plurality of stacked wood layers.

19. The cue stick of claim 18 wherein the wood fibers of said wood layers of said sleeve are oriented in a direction substantially perpendicular to the longitudinal axis of said tip end piece.

20. The cue stick of claim 18 wherein said wood layers of said sleeve are arranged with respect to one another such that the wood fiber orientation of each layer varies from the wood fiber orientation of an adjacent layer.

21. A cue stick having a component comprising at least three longitudinal, rounded wood sections attached together, each of said sections having a longitudinally extending concave surface, a longitudinally extending convex surface, and an arcuate outer surface, wherein the concave surface of each section abuts the convex surface of an adjacent section.

22. The cue stick of claim 21 wherein said component further comprises a first end, a second end opposed to said first end, and a longitudinal cavity disposed between said first end and said second end, said longitudinal cavity being at least 12 inches in length.

23. The cue stick of claim 22 wherein said longitudinal cavity of said component is filled with a vibration-dampening material.

24. The cue stick of claim 21 wherein said rounded longitudinal sections are formed by stepwise removal of outer wood relative to two end points.

25. The cue stick of claim 21 wherein the end grain direction of each section varies from the end grain direction of the sections adjacent thereto.

26. The cue stick of claim 21 wherein said component includes six longitudinal, rounded sections attached together, each of said sections being formed of multiple adjoining layers of wood, said layers arranged longitudinally with respect to the axis of the cue stick, and each of said sections having a longitudinally extending concave surface, a longitudinally extending convex surface, and an arcuate outer surface, wherein the concave surface of each section abuts the convex surface of an adjacent section.

27. The cue stick of claim 26 wherein the end grain direction of each section varies from the end grain direction of the sections adjacent thereto.

28. A cue stick comprising a shaft having a base portion and a tip end piece spaced from said base portion, a cue tip attached to said tip end piece, and a sleeve attached around said tip end piece adjacent to said cue tip to prevent splitting or spreading of said tip end piece, said sleeve comprising a plurality of stacked wood layers wherein the wood fiber orientation of said wood layers is substantially perpendicular to the longitudinal axis of said tip end piece.

29. A cue stick comprising a shaft having a base portion and a tip end piece spaced from said base portion, a cue tip attached to said tip end piece, and a sleeve attached around said tip end piece adjacent to said cue tip to prevent splitting or spreading of said tip end piece, said sleeve comprising a plurality of stacked wood layers wherein said wood layers are arranged with respect to one another such that the grain wood fiber orientation of each layer varies from the wood fiber orientation of an adjacent layer.

30. The cue stick of claim 29 whereby said layers are arranged such that the wood fiber orientation of each layer varies by approximately 45 degrees from the wood fiber orientation of an adjacent layer.

* * * * *